United States Patent [19]

Nakanishi

[11] Patent Number: 4,957,191

[45] Date of Patent: Sep. 18, 1990

[54] GUIDE DEVICE FOR HYDRAULIC ELEVATOR

[75] Inventor: Yoshinori Nakanishi, Chiba, Japan

[73] Assignee: Otis Elevator Company, Farmington, Conn.

[21] Appl. No.: 362,191

[22] Filed: Jun. 6, 1989

[30] Foreign Application Priority Data

Jun. 9, 1988 [JP] Japan ..... 63-142385

[51] Int. Cl.[5] ..... B66B 7/02

[52] U.S. Cl. ..... 187/95; 384/126

[58] Field of Search ..... 187/95, 20, 1 R; 182/141, 142; 384/126, 127; 104/242, 245

[56] References Cited

U.S. PATENT DOCUMENTS 3,856,117 12/1974 Solymos ..... 187/95

FOREIGN PATENT DOCUMENTS 526699 10/1921 France ..... 187/95

52-55143 5/1977 Japan ..... 187/95

*Primary Examiner*—H. Grant Skaggs

*Assistant Examiner*—Kenneth Noland

*Attorney, Agent, or Firm*—William W. Jones

[57] ABSTRACT

Movement of the cab of an elevator is guided along hoistway guide rails by a guide assembly that shares loads imposed by the cab between guide shoes and guide rollers. There is one guide shoe/guide roller sub-assembly mounted above and below the cab for engagement with each guide rail. In each sub-assembly, the guide shoe and guide roller are mounted on opposite ends of a pivoting arm. The guide rollers engage opposite sides of the guide rail blade, and the geometry of the system is such that loads are proportionally shared by the guide shoes and guide rollers.

2 Claims, 1 Drawing Sheet

GUIDE DEVICE FOR HYDRAULIC ELEVATOR

TECHNICAL FIELD

The present invention broadly relates to an elevator and, more particularly, to a cantilevered hydraulic elevator in which the cab is suspended at a position deviated from the centroid thereof so as to be moved up and down along vertical guide rails.

BACKGROUND ART

The cab of a cantilevered hydraulic elevator is suspended for vertical movement at a point which is offset from the centroid thereof so that the cab oscillates up and down each time it starts and stops and each time a passenger walks into and out of the cab. In order to eliminate such a vertical oscillation, the elevator is usually equipped with a guide shoe and/or a guide roller. The guide shoe grips the guide rail so as to effectively suppress vertical oscillation of the cab, while the guide roller is effective in suppressing the oscillation in the direction perpendicular to the guide rails. When both a guide shoe and a guide roller are used, it is necessary that the guide roller and the guide shoe suitably share proper proportions of the load. To meet such a demand, a pressing mechanism has been proposed which incorporates spring means designated to enable the guide roller and the guide shoe to share proper portions of the load. Such a mechanism, however, requires a complicated construction and inevitably suffers from age-induced change in the load sharing.

DISCLOSURE OF THE INVENTION

The present invention provides a guide assembly for a hydraulic elevator which is simple in construction and which does not suffer substantial age-induced change in the load sharing.

To this end, according to the present invention, there is provided a guide device for a hydraulic elevator comprising: a pair of arms rotatably fixed to stationary stands mounted on the cab; and guide shoe and guide roller sets which are secured to the arms at such predetermined distances from the fulcrum of the arms that the guide shoes and the guide rollers share predetermined portions of the cab load.

These guide assemblies are mounted on the top and bottom of the cab respectively with the guide shoes straddling the guide rail, and the guide rollers engaging opposite sides of the guide rail.

It is therefore an object of this invention to provide an improved guide assembly for use in a cantilevered elevator to guide the cab on guide rails in the hoistway.

It is a further object of this invention to provide a guide assembly of the character described wherein there are two guide sub-assemblies, one on the top and one on the bottom of the cab which share the load placed on the guide rail by the elevator cab.

It is another object of this invention to provide a guide assembly of the character described wherein each guide set includes a shoe for straddling the guide rail, and a roller for engaging the side of the guide rail.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 2:
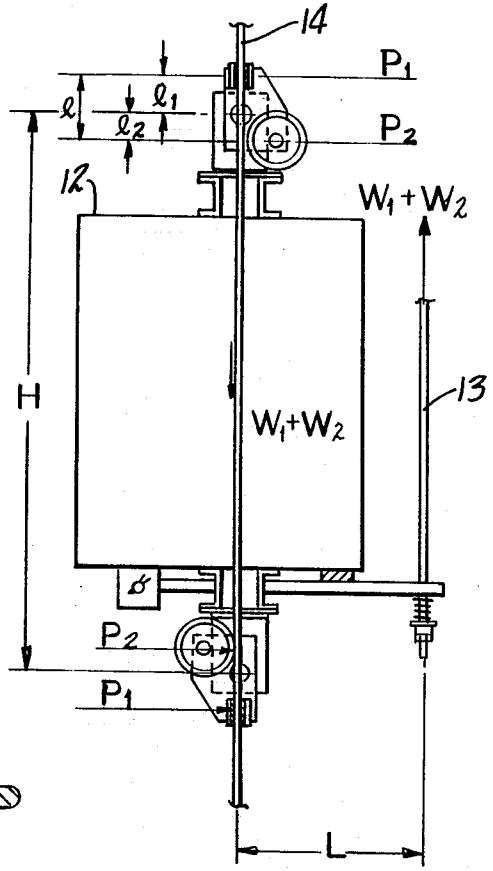
FIG. 2 is a sectional view of one of the guide assembly sub-assemblies taken along line 2—2 of FIG. 1.
Figure 3:
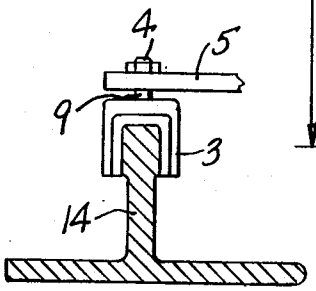
FIG. 3 is a horizontal sectional view of the rail showing how the guide shoe engages the rail.
Figure 1:
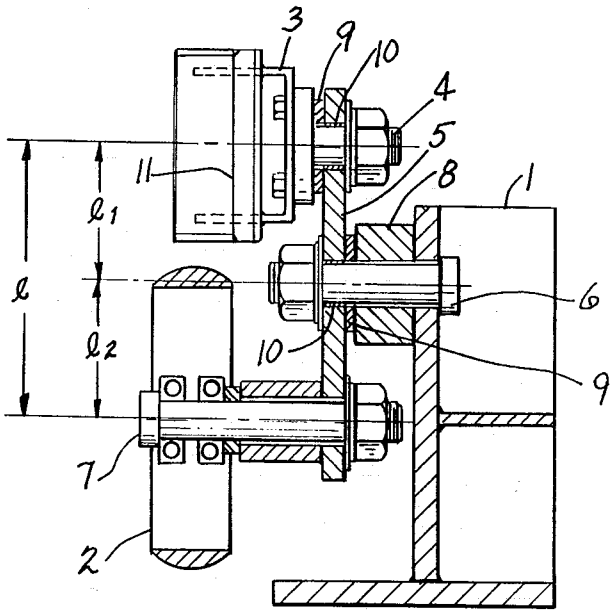
FIG. 1 is a somewhat schematic side elevational view of an elevator which is equipped with the guide assembly of this invention.

Referring to the drawings, a guide device according to the invention has a stand 1 which is fixed to each of the top and bottom plates of the cab. Each stand 1 carries a guide roller 2, a guide shoe 3, a guide shoe shaft 4, an arm 5, an arm shaft 6, a guide roller shaft 7, a spacer 8, a thrust washer 9, and a bearing 10. Numerals 12, 13 and 14 denote, respectively, the cab, a main rope and a guide rail.

The guide shoe 3 and the guide roller 2 are secured to the arm 5 at such distances from the fulcrum 6 of the arm 5 that the guide shoe 3 and the guide roller 2 share portions of load in accordance with the following formulae:

$$P_1=(W_1+W_2)\,L1_1/2H1$$

$$P_2=(W_1+W_2)\,L1_2/2H1$$

where, $P_1$ represents the portion of the load shared by the guide shoe 3; $P_2$ represents the portion of the load shared by the guide roller 2; 1 represents the vertical distance between the center of the guide roller shaft 7 and the center of the guide shoe shaft 4; $1_1$ represents the distance between the fulcrum of the arm shaft 6 and the center of the guide shoe shaft 4; $1_2$ represents the vertical distance between the fulcrum of the arm shaft 6 and the center of the guide roller shaft 7; L represents the distance between the centroid of a cab 12 and the suspension center of the cab 12; H is the distance between the axes of the two arm shafts 6; $W_1$ represents the weight of the cab 12; and $W_2$ represents the load on the cab 12. It will be noted that the upper and lower guide rollers 2 contact opposite sides of the blade of the guide rail 14 respectively.

The formulae are derived from the following conditions.

$$P_1+P_2=(W_1+W_2)L/2H$$

$$P_1/1_1=P_2/1_2$$

The invention provides a guide device for a hydraulic elevator which is simple in construction and which can realize a proper load sharing without any age-induced change.

Since many changes and variations of the disclosed embodiment of the invention may be made without departing from the invention concept, it is not intended to limit the invention otherwise than as required by the appended claims.

What is claimed is:

1. A guide assembly for a cantilevered hydraulic elevator for guiding movement of the elevator cab along guide rails in the elevator hoistway, said assembly comprising:

a. a first guide sub-assembly mounted above the cab, said first sub-assembly comprising a first stand fixed with respect to the cab; a first arm mounted on said stand, said first arm being pivotable about an axis which coincides with a vertical plane of symmetry of the guide rails; a first guide shoe mounted on one pivoting end of said first arm, said first guide shoe embracing the blade portion of said guide rail; and a first guide roller mounted on an opposite pivoting end of said first arm, said first guide roller engaging one surface of the guide rail blade; and b. a second guide sub-assembly mounted below the cab, said second sub-assembly comprising a second stand fixed with respect to the cab; a second arm mounted on said stand, said second arm being pivotable about an axis which coincides with said vertical plane of symmetry of the guide rails; a second guide shoe mounted on one pivoting end of said second arm, said second guide shoe embracing the blade portion of said guide rail; and a second guide roller mounted on an opposite pivoting end of said second arm, said second guide roller engaging the side surface of the guide rail blade opposite to said one side surface thereof.

2. A guide device according to claim 1, wherein in each of said sub-assemblies said guide shoes and said guide rollers are secured to said arms at such distances from the fulcrum of said arms that said guide shoes and said guide rollers share portions of load from the cab in accordance with the following formulae:

$$P_1=(W_1+W_2)\,L1_1/2H1$$

$$P_2=(W_1+W_2)\,L1_2/2H1$$

where for each sub-assembly, $P_1$ represents the portion of the load shared by said guide shoe, $P_2$ represents the portion of the load shared by the guide roller, 1 represents the vertical distance between the center of the guide roller and the center of the guide shoe, $\mathbf{1}_1$ represents the distance between said fulcrum of said arm and the center of said guide shoe, $\mathbf{1}_2$ represents the vertical distance between said fulcrum of said arm and the center of said guide roller, L represents the distance between the centroid of the cab and the suspension center of said cab, H is the distance between the fulcrums of the first and second arms, $W_1$ represents the weight of the cab, and $W_2$ represents the load on the cab.

* * * * *

UNITED STATES PATENT AND TRADEMARK OFFICE

CERTIFICATE OF CORRECTION

PATENT NO. : 4,957,191

DATED : Sep. 18, 1990

INVENTOR(S) : Yoshinori Nakanishi

It is certified that error appears in the above-identified patent and that said Letters Patent is hereby corrected as shown below:

Column 3, line 14, "end of said first" should be --end of said first--.

Column 3, line 15, "engaging one surface" should be --engaging one side surface--.

Signed and Sealed this

Twenty-eighth Day of May, 1991

*Attest:*

*Attesting Officer*

HARRY F. MANBECK, JR.

*Commissioner of Patents and Trademarks*